US008844947B1

(12) United States Patent
Whiteside et al.

(10) Patent No.: US 8,844,947 B1
(45) Date of Patent: Sep. 30, 2014

(54) MOBILE CHAIR

(75) Inventors: Kirt E. Whiteside, Marion, OH (US); Shane Obitts, Elyria, OH (US); Braden C. Schenk, Galena, OH (US)

(73) Assignee: Whiteside Mfg. Co., Delaware, OH (US)

( * ) Notice: Subject to any disclaimer, the term of this patent is extended or adjusted under 35 U.S.C. 154(b) by 156 days.

(21) Appl. No.: 13/563,837

(22) Filed: Aug. 1, 2012

(51) Int. Cl.
*B25H 5/00* (2006.01)

(52) U.S. Cl.
USPC ..... 280/32.6

(58) Field of Classification Search
CPC ..... B25H 5/00
USPC ..... 280/62, 79.11, 32.5, 32, 32.7, 32.76; 5/636
See application file for complete search history.

(56) References Cited

U.S. PATENT DOCUMENTS

| | | | | | |
|---|---|---|---|---|---|
| 1,660,521 | A | * | 2/1928 | Nordgren | 211/70.6 |
| 2,796,155 | A | * | 6/1957 | Cabler | 188/167 |
| 2,798,732 | A | * | 7/1957 | Craig | 280/641 |
| 3,976,155 | A | * | 8/1976 | Esch | 280/32.5 |
| 4,119,044 | A | * | 10/1978 | Hines | 108/27 |
| 4,397,374 | A | * | 8/1983 | Rumage et al. | 182/129 |
| 4,569,532 | A | * | 2/1986 | Mirkarimi | 280/87.051 |
| 4,632,410 | A | * | 12/1986 | Bainbridge et al. | 280/32.5 |
| D294,545 | S | * | 3/1988 | Opsvik | D6/500 |
| D298,674 | S | * | 11/1988 | Koller, Sr. | D34/23 |
| 4,832,355 | A | * | 5/1989 | Hung | 280/32.5 |
| 4,925,245 | A | * | 5/1990 | Pendleton et al. | 297/440.1 |
| 4,957,302 | A | * | 9/1990 | Maxwell | 280/32.6 |
| 5,072,955 | A | * | 12/1991 | Holland et al. | 280/32.5 |
| D353,058 | S | * | 12/1994 | Dallas | D6/336 |
| 5,451,068 | A | * | 9/1995 | Shockley | 280/32.6 |
| D365,935 | S | * | 1/1996 | Dallas | D6/336 |
| 5,577,744 | A | * | 11/1996 | Parks | 280/32.6 |
| 5,611,551 | A | * | 3/1997 | Lin | 280/32.5 |
| D381,821 | S | * | 8/1997 | Miles | D6/353 |
| 5,695,205 | A | * | 12/1997 | Liu | 280/79.2 |
| 5,707,067 | A | * | 1/1998 | Smith | 280/32.6 |
| RE35,732 | E | * | 2/1998 | Shockley | 296/136.07 |
| D399,626 | S | * | 10/1998 | Taylor | D34/23 |
| D400,677 | S | * | 11/1998 | Borner et al. | D34/23 |
| 5,897,122 | A | * | 4/1999 | Borner | 280/32.6 |
| D410,128 | S | * | 5/1999 | Dallas et al. | D34/23 |
| D415,359 | S | * | 10/1999 | Boyd | D6/336 |
| 6,010,187 | A | * | 1/2000 | Dallas et al. | 297/188.08 |
| 6,123,392 | A | * | 9/2000 | Alfred et al. | 297/466 |
| 6,199,877 | B1 | * | 3/2001 | Shockley | 280/32.6 |
| RE37,372 | E | * | 9/2001 | Smith | 280/32.6 |
| 6,302,413 | B1 | * | 10/2001 | Comeaux | 280/32.5 |
| D456,647 | S | * | 5/2002 | Whiteside et al. | D6/498 |
| 6,398,234 | B1 | * | 6/2002 | Brown | 280/32.6 |
| D463,143 | S | * | 9/2002 | Riddle | D6/336 |
| D466,668 | S | * | 12/2002 | Peschmann | D34/23 |

(Continued)

*Primary Examiner* — Hau Phan
*Assistant Examiner* — Jacob Meyer
(74) *Attorney, Agent, or Firm* — Renner, Kenner, Greive, Bobak, Taylor & Weber

(57) ABSTRACT

A mobile chair (10) includes a seat (11), and a tray (12) having a front edge (17) that is shorter than its rear edge (18). A caster assembly (14) is carried by the tray (12) at the front and rear corners of the tray (12). A brace assembly (13) attaches the seat (11) to the tray (12) and includes a tube portion (27) attached to the tray (12) between the caster assemblies (14) at the front corners of the tray (12) and tube portions (34) attached to the tray (12) near the rear corners.

19 Claims, 4 Drawing Sheets

(56) References Cited

U.S. PATENT DOCUMENTS

| | | | | |
|---|---|---|---|---|
| 6,520,609 | B1 * | 2/2003 | Beauregard et al. | 312/235.2 |
| 6,578,859 | B2 * | 6/2003 | Chen | 280/87.01 |
| 6,688,615 | B2 * | 2/2004 | Chen | 280/47.35 |
| 6,702,065 | B2 * | 3/2004 | Ehnes | 182/150 |
| 6,733,073 | B2 * | 5/2004 | Whiteside et al. | 297/188.08 |
| 6,857,644 | B2 * | 2/2005 | Hsiao | 280/79.2 |
| D511,416 | S * | 11/2005 | Obbitts et al. | D6/336 |
| 7,086,702 | B1 * | 8/2006 | Hurt | 297/423.11 |
| 7,097,241 | B2 * | 8/2006 | Tally et al. | 297/118 |
| D530,108 | S * | 10/2006 | Whiteside et al. | D6/349 |
| D531,419 | S * | 11/2006 | Whiteside et al. | D6/352 |
| D531,423 | S * | 11/2006 | Whiteside et al. | D6/367 |
| 7,237,781 | B2 * | 7/2007 | Canova | 280/32.6 |
| D555,920 | S * | 11/2007 | Whiteside et al. | D6/349 |
| D579,679 | S * | 11/2008 | Qian et al. | D6/349 |
| 7,481,438 | B2 * | 1/2009 | Hernandez | 280/32.6 |
| 7,597,392 | B1 * | 10/2009 | Gilmore | 297/217.1 |
| D608,558 | S * | 1/2010 | Rush | D6/367 |
| 7,658,442 | B1 * | 2/2010 | Whiteside et al. | 297/188.11 |
| 7,661,685 | B2 * | 2/2010 | Thibault | 280/47.35 |
| D617,999 | S * | 6/2010 | Hung | D6/335 |
| D618,467 | S * | 6/2010 | Hung | D6/335 |
| D632,904 | S * | 2/2011 | Adams | D6/498 |
| 7,878,513 | B2 * | 2/2011 | Damouzehtash | 280/32.6 |
| D646,497 | S * | 10/2011 | Overthun et al. | D6/375 |
| D658,902 | S * | 5/2012 | Comas | D6/340 |
| D672,986 | S * | 12/2012 | Whiteside et al. | D6/716 |
| D689,723 | S * | 9/2013 | Corcorran et al. | D6/708.23 |
| D690,143 | S * | 9/2013 | Corcorran et al. | D6/708.23 |
| 8,596,651 | B2 * | 12/2013 | Canova | 280/32.5 |
| 2001/0025740 | A1 * | 10/2001 | Ehnes | 182/12 |
| 2002/0121801 | A1 * | 9/2002 | Whiteside et al. | 297/188.08 |
| 2005/0098966 | A1 * | 5/2005 | Canova | 280/32.6 |
| 2008/0067003 | A1 * | 3/2008 | Emge et al. | 182/222 |
| 2008/0093810 | A1 * | 4/2008 | Liu | 280/32.6 |
| 2008/0157492 | A1 * | 7/2008 | Chaykin et al. | 280/32.6 |
| 2008/0258515 | A1 * | 10/2008 | Whiteside et al. | 297/174 R |
| 2009/0115150 | A1 * | 5/2009 | Hernandez | 280/32.6 |
| 2010/0066042 | A1 * | 3/2010 | Damouzehtash | 280/32.5 |
| 2012/0038122 | A1 * | 2/2012 | Canova | 280/32.6 |
| 2013/0020774 | A1 * | 1/2013 | Brittingham et al. | 280/32.6 |

* cited by examiner

MOBILE CHAIR

TECHNICAL FIELD

This invention relates to a mobile chair of the type often used by mechanics. More particularly, this invention relates to such a chair having improved stability and maneuverability.

BACKGROUND ART

There are a wide variety of designs of known mobile chairs such as those used by mechanics to maneuver themselves around while working on portions of vehicles. Typically, these chairs include a lower frame which carries casters, a seat portion, and one or more curved braces which attach the frame to the seat portion. Alternatively, legs could extend from the corners of the seat portion to the corners of the frame. At least some of these units lack the stability required in the environment which finds the mechanic.

The frame of such chairs also typically carries a tray to receive and hold a plurality of tools used by the mechanic. These trays are rectangular in nature and are positioned under the seat. They also extend forward of the seat for ease of access by the mechanic. However, such trays detrimentally affect the maneuverability of the chairs which is controlled by the legs and feet of the mechanic. That is, the positioning of the tray requires that the feet of the mechanic be extended substantially forward of the tray, or spaced substantially wide, straddling the tray. In either of those positions, it is not easy to maneuver the chair especially without having the tray engage the legs of the user.

Thus, the need exists for a mobile chair which has a tray, but which is easy to maneuver, and one which is sturdy and can withstand a mechanic's environment.

DISCLOSURE OF THE INVENTION

It is thus an object of one aspect of the present invention to provide a mobile chair which includes an accessible tray, but one which does not interfere with the maneuverability of the chair.

It is an object of another aspect of the invention to provide a mobile chair in which the attachment of the seat to the lower frame creates a chair with greater stability and strength.

These and other objects of the present invention, as well as the advantages thereof over existing prior art forms, which will become apparent from the description to follow, are accomplished by the improvements hereinafter described and claimed.

In general, a mobile chair made in accordance with one aspect of the present invention includes a seat, a tray, a brace assembly attaching the seat to the tray, and caster assemblies carried by the tray. The tray has a front edge which is shorter than the rear edge.

In accordance with another aspect of the present invention, a mobile chair includes a seat and a tray having front and rear corners. A brace assembly attaches the seat to the tray. A caster assembly is carried by the tray near the front and rear corners. The brace assembly includes a first portion attached to the tray between the caster assemblies at the front corners, a second portion attached to the tray near one of the rear corners, and a third portion attached to the tray near the other rear corner.

In yet another aspect of the present invention, a mobile chair includes a seat and a tray having a front edge, a rear edge, front corners, and rear corners, the front edge being shorter than the rear edge. A brace assembly attaches the seat to the tray, and a caster assembly is carried by the tray near each front corner and each rear corner. The brace assembly includes a first portion attached to the tray between the caster assemblies at the front corners, a second portion attached to the tray near one of the rear corners, and a third portion attached to the tray near the other rear corner.

A preferred exemplary mobile chair according to the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
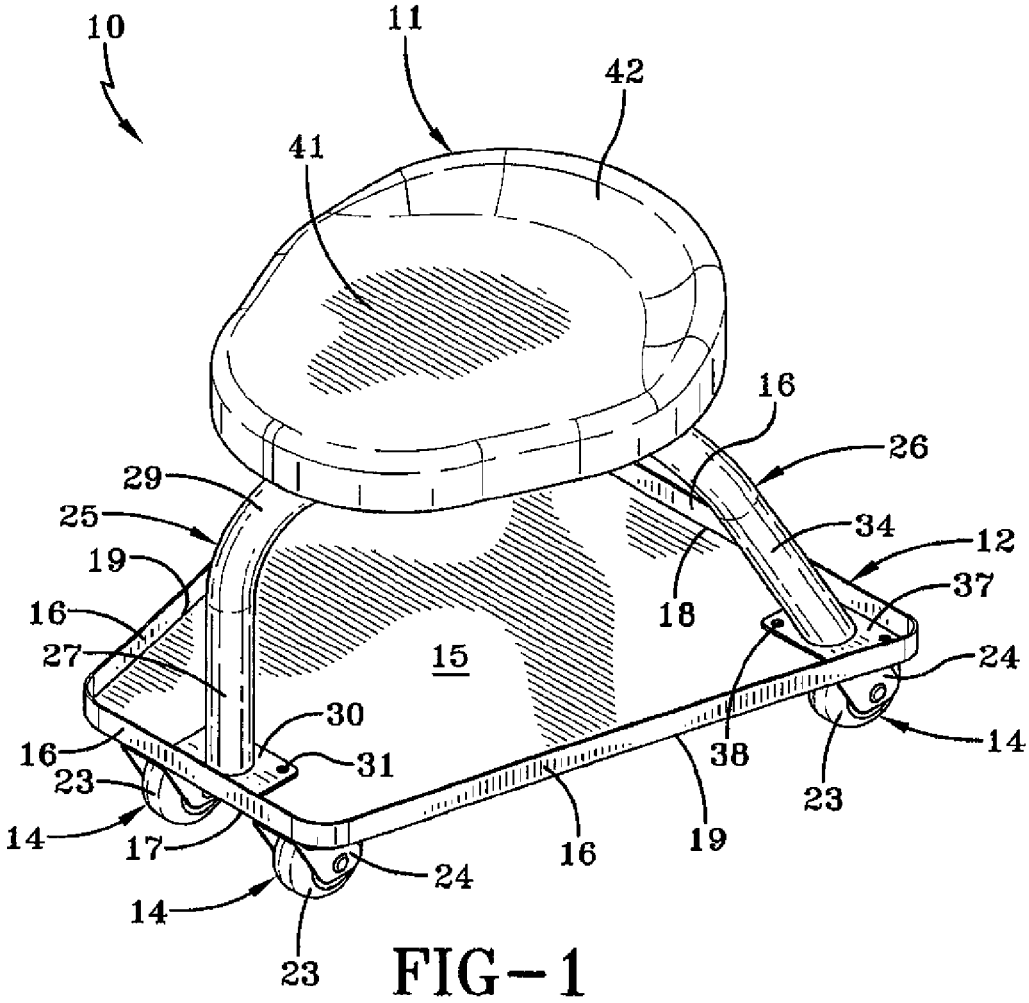
FIG. 1 is a perspective view of a mobile chair made in accordance with the concepts of the present invention.

A mobile chair may in accordance with the present invention is generally indicated by the numeral 10. Chair 10 includes a seat portion generally indicated by the numeral 11, a tray generally indicated by the numeral 12, a support brace assembly generally indicated by the numeral 13, and a plurality of caster assemblies generally indicated by the numeral 14.

Figure 6:
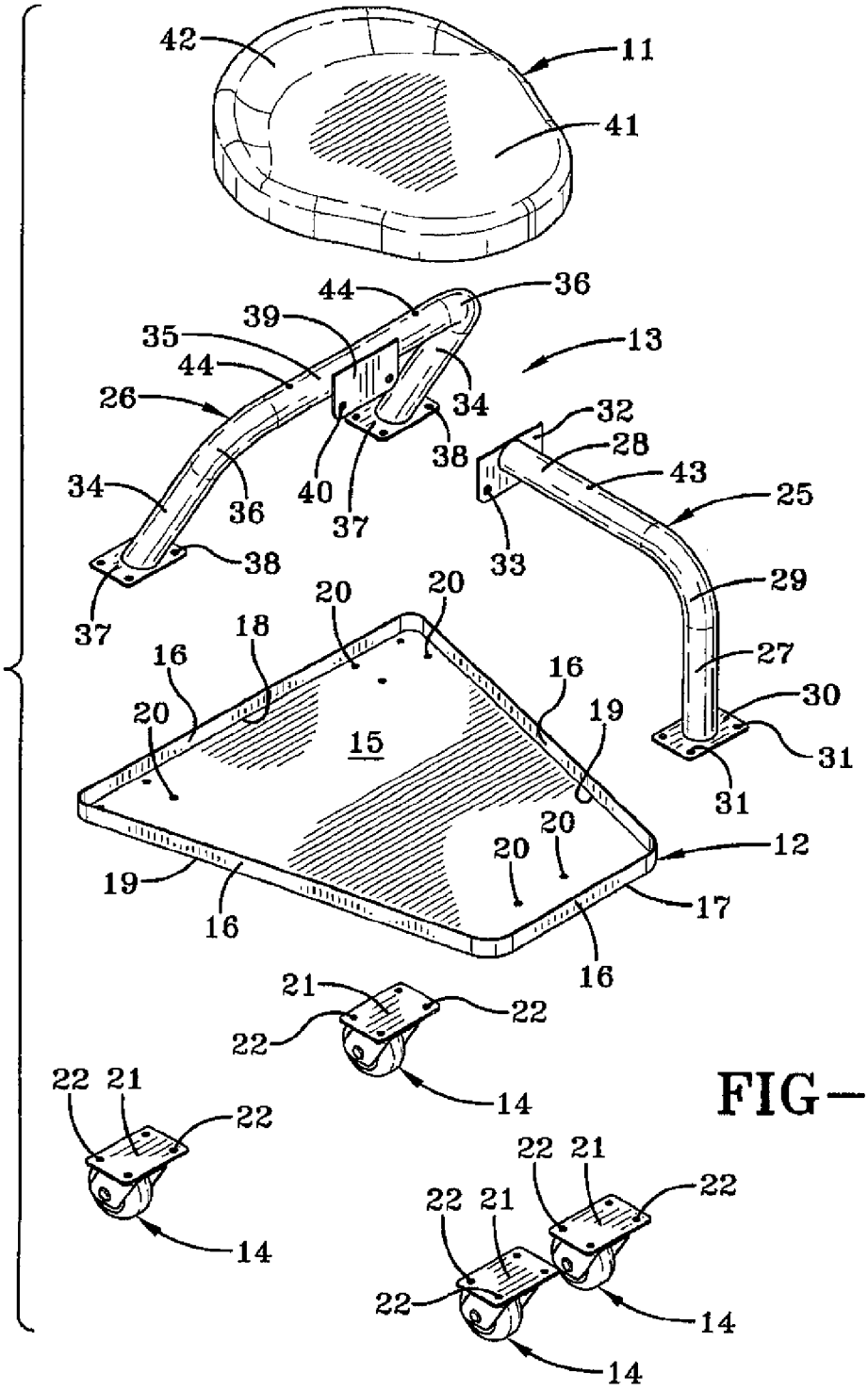
FIG. 6 is an exploded perspective view showing the components of the chair of FIG. 1.

Tray 12 includes a generally horizontal, flat surface 15 which has a flange 16 extending upwardly around its periphery. As such, items can be placed on surface 15 and are confined thereon by flange 16 for ready access to the user of chair 10. Tray 12 and surface 15 are generally trapezoidal in configuration having opposed, generally parallel front and rear edges, 17 and 18 respectively, and opposed side edges 19 which converge toward each other from rear edge 18 to front edge 17. Thus, front edge 17 is shorter in length than rear edge 18. Tray surface 15 is provided with a plurality of holes 20, not all of which are shown in FIG. 6, to receive fasteners (not shown) to attach support brace assembly 13 and caster assemblies 14 to tray 12, as now will be described.

Each caster assembly 14 includes a mounting plate 21 having holes 22 therein to be aligned with the holes 20 in tray surface 15 and to receive fasteners therethrough to attach each caster assembly 14 to tray 12. Each plate 21 carries a conventional caster which includes a wheel 23 carried between arms 24. As shown, two caster assemblies 14 are thus positioned at the rear of tray 12 at the corners where tray side edges 19 intersect tray rear edge 18, and two caster assemblies 14 are positioned at the front of tray 12 at the corners where tray side edges 19 intersect tray front edge 17 thereby rendering chair 10 mobile.

Support brace assembly 13 includes a front brace generally indicated by the numeral 25 and a rear brace generally indicated by the numeral 26. Front brace 25 includes a generally vertical tube portion 27 and a generally horizontal tube portion 28. Tube portions 27 and 28 are interconnected by a curved tube portion 29. A mounting plate 30, having holes 31, is attached, as by welding, to the exposed end of tube portion 27, and a mounting plate 32, having holes 33, is attached, as by welding, to the exposed end of tube portion 28.

Rear brace 26 includes an opposed generally straight tube portions 34 which are connected to the ends of a generally horizontal tube portion 35 by means of curved tubular portions 36. A mounting plate 37, having holes 38, is attached, as by welding, to the exposed end of each of the tube portions 34. An additional mounting plate 39, having holes 40, is welded or otherwise attached tangentially at the general midpoint of horizontal tube portion 35.

Front brace 25 is attached to rear brace 26 to form support brace assembly 13 by aligning holes 33 of plate 32 with holes 40 of plate 39 and attaching the plates with suitable fasteners. The assembled braces 25 and 26 may then be attached to tray 12 by aligning the holes 31 of plate 30 with the holes 20 positioned generally centrally of the front edge 17 of tray surface 15, and by aligning holes 38 of plates 37 with the holes 20 located at the rear corners of tray surface 15. Then by means of suitable fasteners, support brace assembly 13 may be attached to tray 12. It should be noted that the same fasteners that attach tray 12 to caster assemblies 14 at the rear corners of tray surface 15 may be used to attach plates 37 to tray surface 15.

When braces 25 and 26 are attached as just described, horizontal tube portions 28 and 35 intersect generally at a right angle and form a surface to receive seat portion 11. Seat portion 11 includes a horizontal padded seat cushion 41 and a small back rest 42 extending upwardly from the back thereof. However, any configuration for a seat, with or without any back portion of any size, is contemplated by the present invention. The bottom of seat cushion 41 may be provided with support braces (not shown) which could be used to attach seat portion 11 to tube portions 28 and 35. To that end, an aperture 43 may be provided through tube portion 28, and an aperture 44 may be provided through tube portion 35. Suitable fasteners may extend through apertures 43 and 44 and into the bottom of seat cushion 41 to connect seat portion 11 to brace assembly 13.

Figure 2:
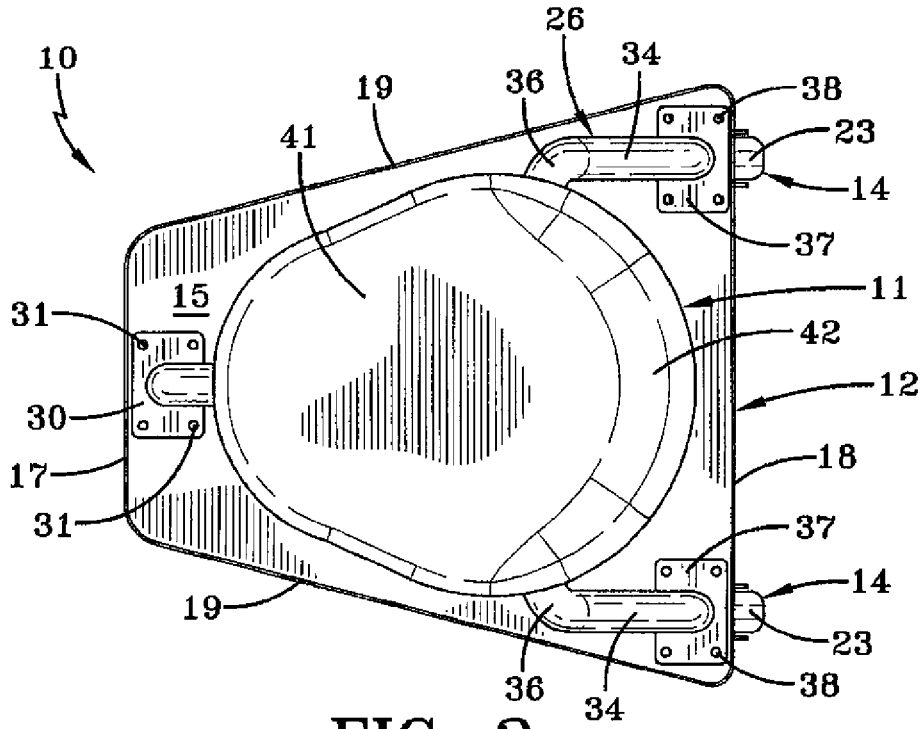
FIG. 2 is a top plan view of the chair of FIG. 1.
Figure 3:
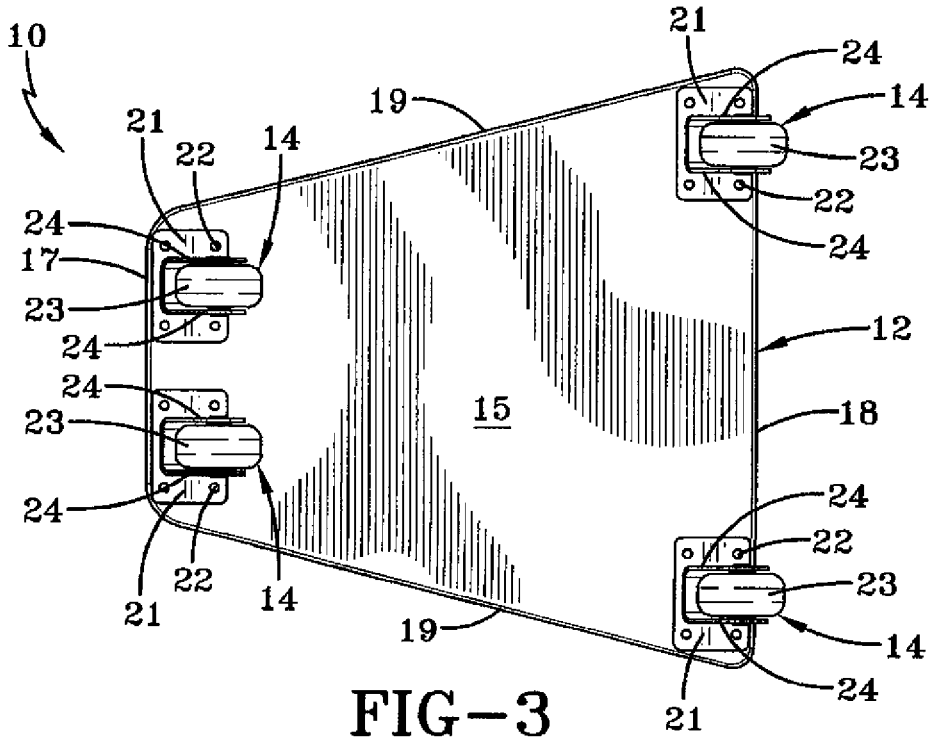
FIG. 3 is a bottom plan view of the chair of FIG. 1.
Figure 4:
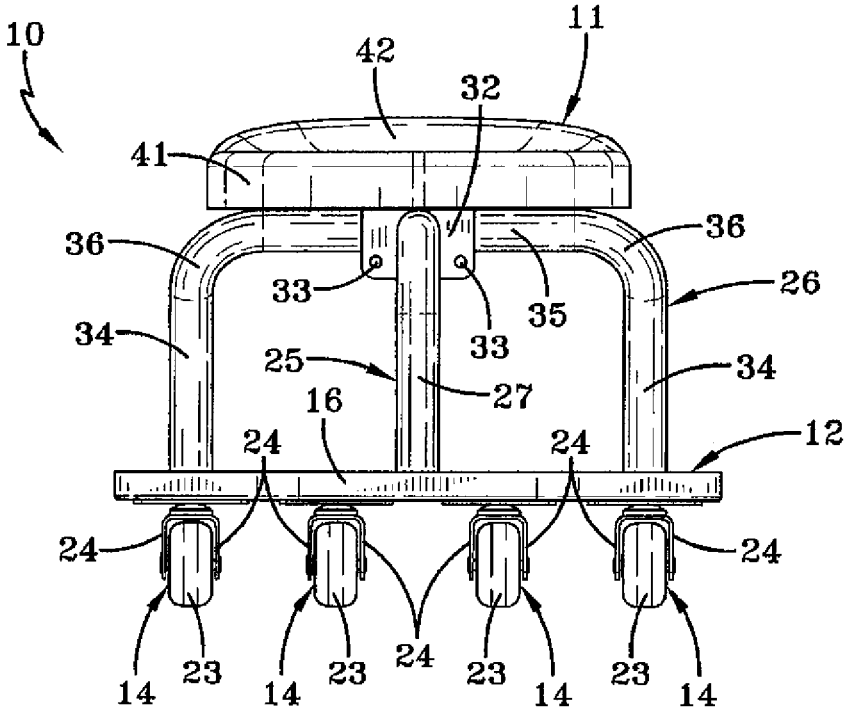
FIG. 4 is a front elevational view of the chair of FIG. 1.

As shown in at least FIGS. 1 and 2, tray 12 extends forward of seat cushion 41. However, because of the configuration of tray 12 having a shorter front edge 17, tray 12 does not interfere with the legs or feet of a user sitting on cushion 41. That is, the feet of the user may be positioned close to side edges 19 at the location of front edge 17 and more easily used to maneuver chair 10 than if front edge 17 were the same length as rear edge 18.

Moreover, the configuration of the caster assemblies on tray 12 and their relationship to support brace assembly 13 renders chair 10 more stable. Specifically, the vertical tube portion 27 of front brace 25 is connected to tray 12 directly in the small space between the front corner casters so that the weight of the user which is being borne by brace 25 is evenly distributed between the front casters.

Figure 5:
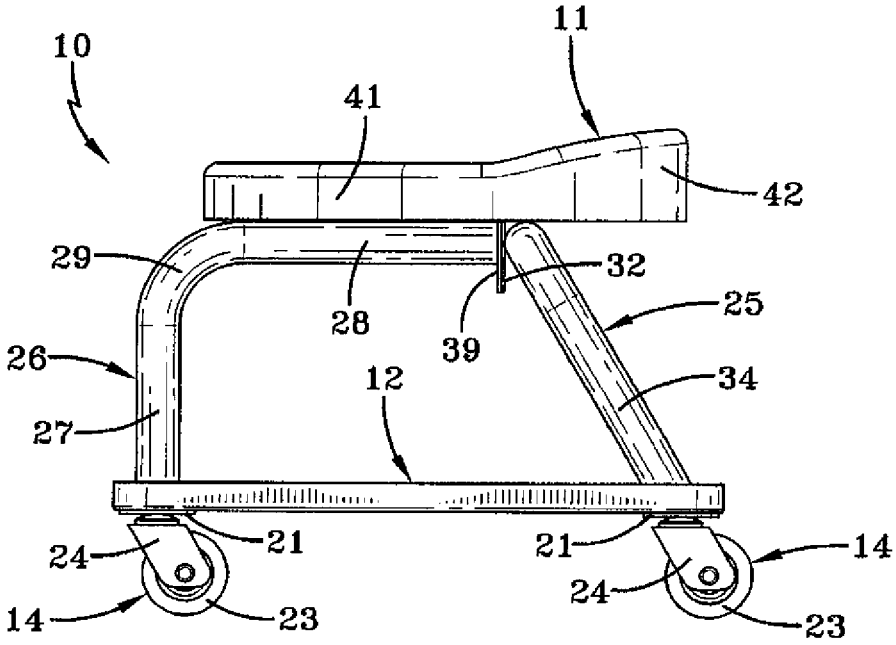
FIG. 5 is a side elevational view of the chair of FIG. 1.

In addition, the configuration and mounting of rear brace 26 contributes to the improved results provided by chair 10. In this regard, as best seen in FIG. 5, tube portions 34 of rear brace 26 extend from under seat cushion 41, at a point where most of the weight of the user will be located, angularly and directly toward the rear corners where the rear caster assemblies 14 are located. This evenly divides the weight of the user which is being borne by brace 26 between these two caster assemblies. The angle of tube portions 34 is preferably about forty-five degrees, although differing angles could be contemplated dependent on the size of seat 11 and tray 12.

It should thus be evident that a chair 10 constructed as described herein accomplishes the objects of the invention and otherwise substantially improves the art.

What is claimed is:

1. A mobile chair comprising a seat, a tray, a brace assembly attaching said seat to said tray, and caster assemblies carried by said tray, said tray having a rear edge and a front edge, said front edge being shorter than said rear edge, said brace assembly including a front brace having a generally centrally located horizontal tube attached to said seat and a generally vertical tube attached generally centrally to said front edge of said tray.

2. The chair of claim 1 wherein said tray has opposed side edges converging from said rear edge to said front edge.

3. The chair of claim 1 wherein said tray is in the shape of a trapezoid.

4. The chair of claim 1, said tray including a flat surface having said rear edge and said front edge and having side edges between said front and rear edges, and a flange extending upwardly from all said edges.

5. The chair of claim 1 wherein said tray has front corners and one of said caster assemblies is attached to said tray near each said front corner, said vertical tube being attached to said tray between said caster assemblies attached at said front corners.

6. A mobile chair comprising a seat, a tray, a brace assembly attaching said seat to said tray, and caster assemblies carried by said tray, said tray having a rear edge and a front edge, said front edge being shorter than said rear edge, wherein said brace assembly includes a rear brace having a generally horizontal tube attached to said seat, a mounting plate attached to said tube of said rear brace, and a front brace having a generally horizontal tube attached to said seat, said horizontal tube of said front brace having a mounting plate attached thereto, said mounting plates being attached to each other to form said brace assembly.

7. The chair of claim 1 wherein said brace assembly includes a rear brace having a generally horizontal tube attached to said seat and a straight tube extending from each end of said horizontal tube, said straight tubes being attached to said tray.

8. The chair of claim 7 wherein said tray has rear corners and one of said caster assemblies is attached to said tray near each said rear corner, said straight tubes being attached to said tray directly above said rear corners.

9. The chair of claim 8 wherein said straight tubes extend angularly from a position under said seat to said rear corners of said tray.

10. A mobile chair comprising a seat; a tray having front corners and rear corners; a brace assembly attaching said seat to said tray; and a caster assembly carried by said tray near each said front corner and near each said rear corner; said brace assembly including a generally centrally located first portion attached to a front edge of said tray between said caster assemblies, a second portion attached to said tray near one of said rear corners, and a third portion attached to said tray near the other of said rear corners.

11. The chair of claim 10 said brace assembly further including a fourth generally horizontal portion connected to said first portion, said fourth portion being attached to said seat.

12. The chair of claim 11 said brace assembly including a fifth generally horizontal portion extending between said second and third portions, said fifth portion being attached to said seat.

13. The chair of claim 12 said brace assembly including a mounting plate on said fourth portion and a mounting plate on said fifth portion, said mounting plates being connected to attach said fourth portion to said fifth portion.

14. The chair of claim 10 wherein said second and third portions extend angularly from under said seat to said rear corners.

15. The chair of claim 10 said tray having a front edge extending between said front corners and a rear edge extending between said rear corners, said front edge being shorter than said rear edge.

16. The chair of claim 15 wherein said tray has opposed side edges converging from said rear edge to said front edge.

17. The chair of claim 15 wherein said tray is in the shape of a trapezoid.

18. The chair of claim 15, said tray including a flat surface having said rear edge and said front edge and having side edges between said front and rear edges, and a flange extending upwardly from all said edges.

19. A mobile chair comprising a seat, a tray having a front edge and a rear edge and front corners and rear corners, said front edge being shorter than said rear edge; a brace assembly attaching said seat to said tray; and a caster assembly carried by said tray near each said front corner and near each said rear corner; said brace assembly including a generally centrally located first portion attached to said tray between said caster assemblies at said front edge of said tray, a second portion attached to said tray near one of said rear corners, and a third portion attached to said tray near the other of said rear corners.

* * * * *